United States Patent [19]

McCready

[11] Patent Number: 4,490,181

[45] Date of Patent: Dec. 25, 1984

[54] ALKALINE CLEANING OF TIN SURFACES

[75] Inventor: Newton W. McCready, Newtown Square, Pa.

[73] Assignee: Amchem Products, Inc., Ambler, Pa.

[21] Appl. No.: 443,626

[22] Filed: Nov. 22, 1982

Related U.S. Application Data

[63] Continuation of Ser. No. 268,752, Jun. 8, 1981, abandoned, which is a continuation-in-part of Ser. No. 163,566, Jun. 27, 1980, abandoned.

[51] Int. Cl.[3] ..... C23G 1/18

[52] U.S. Cl. ..... 134/2; 134/40; 252/135; 252/156

[58] Field of Search ..... 134/2, 40; 252/135, 252/156

[56] References Cited

U.S. PATENT DOCUMENTS

| | | | |
|---|---|---|---|
| 1,744,463 | 1/1930 | Gravell | 252/156 X |
| 2,428,187 | 9/1947 | Wegst et al. | 252/156 |
| 3,653,095 | 4/1972 | Dupre et al. | 252/156 X |
| 3,681,250 | 8/1972 | Murphy | 252/156 X |
| 3,956,380 | 5/1976 | Henning et al. | 252/156 X |
| 4,094,701 | 6/1978 | Fekete | 134/2 |

FOREIGN PATENT DOCUMENTS 252362 12/1947 Switzerland .

OTHER PUBLICATIONS

Talati et al (I), *Br. Corros. J.*, "Dihydroxy-benzenes as Corrosion Inhibitors for Aluminum-Copper Alloy in Sodium Hydroxide", vol. 10, No. 2, 1975, pp. 103-106.

Talati et al (II), *Br. Corros. J.*, "o-Substituted Phenols as Corrosion Inhibitors for Aluminum-Cooper Alloy in Sodium Hydroxide", vol. 12, No. 3, 1977, pp. 180-184.

Rompps Chemie-Lexikon, 1977, p. 3462.

*Primary Examiner*—Marc L. Caroff

*Attorney, Agent, or Firm*—Alexis Barron; Martin F. Savitzky

[57] ABSTRACT

A process for cleaning soil, lubricants or other such contaminants from tin surfaces without visibly etching the tin surface by applying aqueous alkaline cleaning solutions to said surfaces. Spraying is a preferred means for contacting the surface with the solutions. The cleaning solutions may be effectively employed at temperatures as low as about 100° F. and thus may be characterized as low temperature cleaners. The cleaning solutions comprise an alkaline component in an amount effective to substantially remove said contaminants from the tin surface and an inhibitor in an amount effective to inhibit or deter etching of the tin surface. The inhibitor is a compound selected from the group consisting of substituted benzenes having at least two or more hydroxy substituents, quinones and substituted quinones.

38 Claims, No Drawings

ALKALINE CLEANING OF TIN SURFACES

REFERENCE TO RELATED APPLICATIONS

This application is a continuation of application Ser. No. 268,752, filed June 8,1981, which is a continuation-in-part of application Ser. No. 163,566, filed June 27, 1980, both now abandoned.

FIELD OF THE INVENTION

This invention relates to a process and a composition for cleaning metal surfaces and more particularly relates to an aqueous alkaline cleaning solution containing a corrosion inhibitor which deters or inhibits etching of the metal surface.

BACKGROUND OF THE INVENTION

The invention will be described in connection with the cleaning of tin-plated surfaces, such as tin cans, which are soiled with organic lubricants that are applied to the tin surface as drawing aids during cold forming operations. The invention has, nevertheless, broader applicability.

Cleaning is essential as a preliminary to many surface finishing operations. It is normally required, for example, prior to corrosion preventive treatments and prior to the application of organic finishes to the surface, and is especially important in the case of metal surfaces to which organic materials have been recently applied as an aid to cold forming. These materials must be removed in order to obtain a surface suitably receptive to an organic or inorganic finish.

One example of the need for such cleaning is in the manufacture of two-piece, tin-plated, drawn and ironed cans. Circular blanks of tin-plated steel, which, due to the high cost of tin, generally have only a thin layer of tin plating, are first cupped and then passed through several drawing dies to iron the cup in order to form a unitary side wall and can bottom structure. A can produced by this process may be characterized as a thin-walled, thick-bottomed container having a generally uniform wall thickness. Such cans will be referred to herein as "DI" (drawn and ironed) cans. These forming operations are assisted and the dies and metallic surface protected by the application of lubricants to the tin-plate surface prior to or during the forming operation. The lubricants that are deposited on the tin surface usually consist of various types of mineral and vegetable oils and heavy metal soaps. Since it is desired to have a clean surface in order to assure adhesion of a subsequently applied sanitary lacquer and/or decorative varnish, the cleaning step after forming is critical to a successful manufacturing process.

A serious problem with DI tin-plated containers is that the drawing operation stretches the tin-plate surface, thereby exposing some of the underlying metal, which exposure may lead to corrosion. The underlying metal may be a ferrous metal, such as iron, iron alloys, and a wide variety of steels.

A problem with cleaners for tin-plate has been to obtain a cleaner that will provide a water-break-free surface without unduly etching the tin and without promoting corrosion of the underlying metal. A water-break-free surface is a surface that is sufficiently freed of lubricants, soil, and other contaminants so that it will maintain a continuous film of water.

Etching results from chemical attack of the cleaner on the tin surface and results in a roughened and dull surface. Furthermore, etching removes a portion of the corrosion protective tin from the surface, thereby degrading the anti-corrosion qualities of the surface and aggravating the problem of corrosion due to exposure of the underlying metal. Where a smooth, shiny surface is desired, such as in the case of a beverage can, etching and/or corrosion is clearly undesirable.

Another problem with cleaners for tin-plate has been that they do not protect against conditions on the processing line where, after drawing and ironing and cleaning, line stoppage can expose the cleaned cans to the cleaner for prolonged periods of time. This prolonged exposure can lead to corrosion of the underlying surface exposed due to stretching or due to etching, thereby rendering the containers unacceptable for use. Additionally, any corrosion and blemishes on the surface will adversely affect the adhesion of any conversion coating or sanitary lacquer coating that is applied thereafter.

Alkaline cleaners, such as aqueous solutions of alkali metal salts of silicates, phosphates, carbonates and borates, which have been found to be most suitable for producing the desired water-break-free surface, possess the undesirable tendency to etch the surface. It has previously been discovered that the addition of certian compounds to the aqueous alkaline cleaning solutions will help to inhibit etching of the tin surface under the alkaline conditions employed.

REPORTED DEVELOPMENTS

Inhibitors, such as the alkali metal salts of chromates, dichromates and, to a lesser extent, silicates have previously been added to the aforementioned aqueous alkaline solutions to inhibit etching of the tin surface. The resultant cleaners have generally been applied at temperatures in excess of 150° F. Complete protection of the tin surface from etching is not always possible with such inhibitors, especially at a pH above about 12, since the attack of the alkaline compound on the tin surface tends to increase with increasing pH. Such cleaners having a pH below about 12 have less tendency to attack the tin surface and, hence, the well-known inhibitors are more effective, but the cleaning action of these lower pH cleaners is usually slow, making it necessary to treat the tin surface for a prolonged period of time to effect cleaning. Additionally, when a chromium compound is used as the inhibitor, there are problems with toxicity and environmentally objectionable plant effluents.

A number of patents have been directed to compositions and processes for cleaning tin surfaces. The cleaner disclosed in these patents are applied at temperatures of at least 140° F. and thus may be characterized as high temperature cleaners.

U.S. Pat. No. 2,836,566 describes a cleaning composition for tin surfaces that, when added to water, comprises an aqueous solution of an alkaline metal metasilicate; a water-soluble copper salt selected from the group consisting of sulfate, chloride, acetate and cyanide; an amine selected from the group consisting of 1,3-diamino butane, monoethanolamine, 2-amine-2-methyl 1-propanol and a triethanolamine; and soda ash. The solutions have a pH above about 11.8. One example discloses that the tim surface may be cleaned by immersion in the solution at boiling temperature within a 15-minute period.

The solution temperature and the cleaning time are economically disadvantageous due to the energy requirements for maintaining a cleaning solution at boiling temperature concurrent with the requirement that the object to be cleaned be immersed for about 15 minutes. Additionally, the requirement of a copper salt, including copper cyanide, presents waste disposal and toxicity problems that add to the cost of the cleaning process employing these solutions and makes them undesirable for use on beverage cans and the like. Further, it is possible that when using a solution containing a copper salt, some copper will be plated on the tin surface. This is objectionable since the copper may be visible and a uniform shiny tin surface is generally preferred by, for example, manufacturers who purchase cans to be filled with beverages.

U.S. Pat. No. 3,888,783 discloses a cleaning composition that, when added to water, forms an aqueous solution for cleaning tin-plated ferrous metal surfaces. The aqueous solution contains an alkali metal metasilicate, a condensed phosphate selected from the group consisting of tripolyphosphate and pyrophosphate, and borax. The alkali metal metasilicate is said to increase the detergency of the solution and to provide added protection of the surface from corrosion prior to conversion coating.

The cleaning solutions are applied to the surface for fifteen seconds to about one minute at temperatures of from about 150° to 190° F. The preferred temperatures is from about 150° to 170° F. The pH is maintained at a level within the range of frm about 9.0 to about 10.15. All of the examples disclose solutions having a pH less than 10 and a temperature of at least 160° F.

The solutions possess certain disadvantages. The primary disadvantage is that the solutions must be applied at temperatures in excess of 150° F. and thus require a greater energy expenditure and therefore cost more to use than would a significantly lower temperature cleaner. Furthermore, both borates and phosphates may present environmental problems and, hence, may present plant effluent treatment problems.

U.S. Pat. No. 4,094,701 discloses a process for cleaning a tin surface without substantially etching the tin. The process comprises contacting the surface with an aqueous alkaline solution containing an alkaline component which may be an alkali metal borate, carbonate, phosphate, hydroxide, oxide, silicate, or mixtures thereof; one or more surfactants; and, as an inhibitor, an organic tannin. The object to be cleaned is sprayed with the solution at elevated temperature for about one to about two minutes. The pH of the cleaner is at least 9, preferably between 10 and 13, and most preferably between 10 and 10.5. Higher pH values tend to gradually inactivate the tannin. The patent teaches that temperatures of 140° F. and upwards will normally be employed when the cleaner is adjusted to the preferred pH range. Thus, the patent teaches employing the cleaner disclosed therein at temperatures in excess of 140° F. and at pH values between 9 and 10.5.

The patent discloses that alkali metal borates and phosphates may be used. Both borates and phosphates may present environmental problems and, hence, may present plant effluent treatment problems. While the patent discloses a cleaning solution that may be used for cleaning tin surfaces, without etching, at temperatures below boiling and for periods of time less than two minutes, the use of temperatures in excess of 140° F. is still economically disadvantageous.

Thus, there still exists the need for a composition that may be used effectively on tin surfaces to produce water-break-free surfaces without etching the tin at lower temperatures than previously, effectively employed when applied for periods of about one minute or less and for periods of time longer than have previously been disclosed for use without etching in order to realize a significant cost savings, reduce the possibility of etching and corrosion during line stoppage, and minimize the expenditure of energy, without the use of components presently known to be environmentally objectionable.

OBJECTS OF THE INVENTION

It is, therefore, an object of the present invention to provide compositions, solutions, and a process for cleaning tin surfaces and, particularly, tin-plated metal surfaces, so that they are water-break-free without etching the tin and to do so at lower temperatures than have heretofore effectively been employed, and without the use of components presently known to be environmentally objectionable.

It is a particular object of the present invention to provide a low temperature aqueous alkaline solution for cleaning tin-plated metal surfaces so that they are water-break-free without etching of tin.

It is a further object of the present invention to provide cleaning compositions and a process for their use for cleaning tin-plated metal surfaces at low temperatures to produce a water-break-free surface without etching the tin.

SUMMARY OF THE INVENTION

In accordance with one aspect of this invention, there is provided a process for cleaning tin surfaces to substantially remove soil, lubricants or other contaminants therefrom without visibly etching the tin surface by applying to said tin surface an aqueous alkaline cleaning solution having a pH of about 11 to about 13 and comprising an alkaline component in an amount effective to substantially remove said contaminants from the tin surface and an inhibitor, in an amount effective to inhibit etching of the surface, selected frm the group consisting of substituted benzenes having at least two hydroxy substituents, quinones and substituted quinones.

In accordance with another aspect of this invention, there is provided an aqueous cleaning solution having a pH of about 11 to about 13 for cleaning tin surfaces to substantially remove soil, lubricants or other contaminants therefrom without visibly etching the tin surface, and comprising an alkaline component, in an amount effective to substantially remove from the tin surface contaminants thereon, and an inhibitor, in an amount effective to inhibit etching of the surface, selected from the group consisting of quinones, substituted quinones, and substituted benzenes having at least two or more hydroxy substituents in the ortho, para, meta, symmetric or assymmetric configurations.

DETAILED DESCRIPTION OF THE INVENTION

The alkaline component in the cleaning solution useful in the process and composition of this invention may be any of the compounds known to the art that produces an alkaline solution when dissolved in water. Preferably the alkaline component is applied in the form of a compound selected from the group consisting of alkali metal hydroxides, carbonates and silicates, ammonium hydroxides and carbonates, and mixtures thereof.

Particularly preferred as the alkaline component is a mixture of sodium carbonate, sodium metasilicate and a compound selected from the group consisting of sodium hydroxide and potassium hydroxide.

The alkaline component is present in the cleaning solution in an amount effective to substantially remove soil, lubricants or other such contaminants. Generally, more of the alkaline component will be required when the solution is applied at higher temperatures and less will be required when the solution is applied at lower temperatures. Preferably, the amount of alkaline component in the solution will be at least about 2 g/l, and more preferably will be about 3 g/l to about 5 g/l. Greater concentrations may be employed but the benefit to be gained thereby is generally not significant.

The cleaning solution will generally have a pH value within the range of about 11 to about 13 and may preferably have a pH value within the range of about 12 to about 12.8. The pH is determined at a solution temperature of about 27° C.

The inhibitor of the cleaning solution useful in the process of this invention is a compound selected from the group consisting of substituted benzenes having at least two or more hydroxy substituents, quinones, and substituted quinones. A mixture of inhibitors can also be used. Exemplary substituents in the benzene ring include, in addition to hydroxy, halo, alkyl, carboxy, nitro, cyano and alkoxy. Such substituents are also exemplary of substituents of the substituted quinone.

Exemplary quinones and substituted quinones useful as inhibitors in the practice of this invention include 1,2-benzoquinone and 1,4-benzoquinone and the substituted quinones according to Formulae II and III.

Formula II

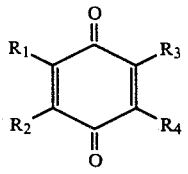

Formula III

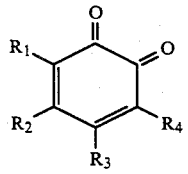

wherein:

$R_1$, $R_2$, $R_3$ and $R_4$ are hydrogen, alkyl, alkoxy, hydroxy, halo, nitro, cyano, or carboxyl; or $R_1$ and $R_2$ form an alkyldienyl group and, together with the quinone ring to which they are attached, form a naphthaquinone.

Exemplary substituted benzene inhibitors, of particular interest in the composition of this invention, include polyhydroxybenzenes, such as catechol, resorcinol, 1,4-dihydroquinone, 1,2,4-trihydroxybenzene, 1,3,5-trihydroxybenzene and 1,2,4,5-tetrahydroxybenzene.

Preferred inhibitors for use in the process of this invention include 3,4,5-trihydroxybenzoic acid, 1,2,3-benzene triol and dihydroxybenzenes and quinones, such as, 1,4-benzenediol and 1,4-benzoquinone.

The inhibitor is added in an amount effective to inhibit etching of the surface. Generally, as the concentration of the alkaline component increases, the concentration of the inhibitor required will also increase. Also, as will be discussed below, since "soft" water tends to be more corrosive than "hard" water, a greater concentration of inhibitor will generally be required when the cleaning solutions are formulated using soft water than will be required when formulated with hard water. Preferably, the amount of inhibitor in the solution will be at least about 0.02 g/l, and more preferably will be about 0.02 g/l to about 0.06 g/l. Concentrations greater than 0.06 g/l may be effectively employed but the resultant increase in cost is not generally offset by a greater inhibition of etching.

It has been discovered that the addition of a polyelectrolyte to the cleaning solutions of the invention provides a solution that may be effectively employed regardless of the hardness of the water used to formulate the solution without generally experiencing precipitation of the calcium and magnesium ions that cause water hardness. Such precipitation is a problem since it may result in sediment that may, for example, clog spray nozzles when spraying is the chosen method of application.

Polyelectrolytes are high molecular weight electrolytes of either natural origin, such as proteins, or of a synthetic nature, such as polymerized organic acids. Since the polyelectrolytes in solution do not dissociate to give a uniform distribution of positive and negative ions, as do simple electrolytes, the ions of one sign are bound to the polymer chanin. Thus, for instance, the negative charges may be in the polymer chain, and only positive ions will be free to diffuse through the solvent.

Hardness is a characteristic of water generally accepted to represent the total concentration of calcium and magnesium ions. Other polyvalent cations that are seldom present in more than trace amounts may also contribute to hardness. Determination of hardness may be made by titration as set forth in "Standard Methods of Test for Hardness in Water", Designation D 1126-67 (Reapproved 1974) published by the American Society for Testing and Materials. Hardness may be given in parts per million (ppm) of calcium carbonate equivalent. The higher the value, the greater the hardness. Water hardness may vary greatly from one plant site to another. Generally, water having a hardness of less than about 100 ppm may be considered "Soft" whereas water having a hardness above about 100 ppm may be considered "hard". In some coastal regions the hardness may be only about 50 ppm to about 100 ppm and may increase to about 300 ppm where the water runs at some point through limestone deposits. In some areas of the midwest, the hardness may be about 400 ppm to about 500 ppm. Precipitation will generally be experienced to a great extent as the hardness of the water increases. As hardness decreases, the water may tend to become more corrosive. Therefore, a polyelectrolyte is preferably, but optionally, added to the cleaning solutions of the present invention.

The polyelectrolyte, when added, may be any of the compounds known to the art to prevent precipitation of the minerals that cause water hardness. If a polyelectrolyte is selected that does not contain phosphate, certain advantages may be realized. An important advantage is that the plant effluent will not contain phosphates since phosphates may be considered environmentally objectionable. Additionally, the alkali metal tripolyphosphates, which have previously been employed, may have the deleterious effect of promoting etching or detinning. Thus, polyelectrolytes preferred for use in the cleaning solutions of the present invention are polyelectrolytes such as Gantrez, S-95 manufactured by GAF Corporation, and Tamol 960 manufactured by Rohm and Haas Company. These polymers do not promote detinning and may inhibit etching to some extent.

The polyelectrolyte, when added, is preferably added in an amount effective to substantially prevent precipitation of the calcium and magnesium ions that are the primary cause of water hardness. Generally, greater amounts of polyelectrolyte will be required when the hardness of the water is high than when hardness of the water is low. Preferably, the amount of polyelectrolyte will be at least about 0.1 g/l and more preferably from about 0.1 g/l to about 1 g/l. Concentrations in excess of 1 g/l may be present in the cleaning solutions but, generally, higher concentrations will not result in a significant improvement in the desired effect.

It is preferred but not essential to add one or more surfactants to the aqueous alkaline cleaning solutions of the present invention. Additionally, when a surfactant is added that is not a low foaming surfactant, a defoaming agent is desirably added. A defoamer is desirable in such a case since foaming can present a serous problem to a commercial operation in that it may delay or shut down the cleaning line. Such materials enhance the performance of the cleaning solution but are not the essence of the invention since they are used to perform functions essentially similar to the function they perform in prior art solutions. The presence or absence of surfactants has been found to have no noticeable effect as far as inhibiting or promoting the etching of a tin surface by the cleaning solution.

Exemplary of the surfactants and wetting agents that can be employed in the cleaning solutions are ethoxylated straight chained alcohols and octyl or nonyl phenoxy polyethoxyethanol. Generally, nonionic surfactants are preferred since they are low foaming.

When surfactants are added, it is preferred that the cleaning solutions contain at least about 0.2 g/l of one or more surfactants. A particularly preferred amount is from about 0.2 g/l to about 0.5 g/l.

Tin surfaces may be cleaned by contacting the surface with the aqueous alkaline cleaning solutions of the present invention for a time at a temperature effective to remove soil, lubricants or other such surface contaminants therefrom without visibly etching the tin surface. Generally, the solution temperature will be at least about 100° F. A preferred range is from about 100° F. to about 130° F. and more preferably from about 115° F. to about 125° F. The temperature employed may tend to be higher for solutions having low concentrations of alkaline components than for solutions having higher concentrations of alkaline components. Thus, the treatment temperature may tend to vary somewhat inversely with the pH of the cleaning solution.

The time of treatment will generally depend on the method of application. A preferred method of application is spraying and when this method is used the treatment time will tend to decrease as the spraying pressure increases. Means for spraying as presently known in the art generally operate at spraying pressures of about 25 psi to about 35 psi and treatment times of about 40 seconds to about one minute may be sufficient to produce a water-break-free surface. Means for spraying at pressures of 60 psi to 100 psi are known but not generally used at present and may employ effective treatment times of about 1 to 5 seconds. Spraying is merely exemplary of the methods of application. Any conventional means known to the art may be used to contact the tin-plated surface with the cleaning solution.

The treatment time will also tend to increase the longer the interval between manufacture of the tin-plated metal article and the cleaning thereof. With drawn and ironed tin-plated steel cans, an interval of as little as fifteen minutes may noticeably result in an increased cleaning time. Additionally, the treatment time may vary depending on the type of lubricant used in the manufacturing process; some lubricants being more readily removed than others.

Application times of up to about 30 minutes have been employed for purposes of determining the extent to which the present cleaning solutions will inhibit etching of the tin and it has been determined that a tin-plated surface may be contacted with the present solutions for up to about 30 minutes without etching the tin. In actual practice, however, it is contemplated that the shortest time effective to produce a water-break-free surface without etching the tin will be employed in applying the present compositions to the tin surface to be cleaned in order to realize the greatest cost efficiency. After the tin surface is treated with the cleaning composition, the surface will generally be rinsed at least once with tap water and then may be rinsed with deionized water and dried at elevated temperature, preferably from about 350° to about 400° F.

Thus, surprisingly, the present compositions, when formulated as an aqueous alkaline cleaning solution and contacted with a tin-plated metal surface for a period as long as about 30 minutes, will not visibly etch the tin. The present solutions, therefore, provide significantly increased protection against etching and corrosion over the prior art solutions in the event of line stoppage or similar such prolonged exposures to the cleaning solutions. Additionally, whereas the prior art solutions have required temperatures in excess of 140° F. in order to effectively clean the tin surface to produce a water-break-free surface without visibly etching the tin, the present cleaning solutions may be effectively employed at temperatures as low as at least about 100° F. amd may preferably be employed at temperatures of from about 100° F. to about 130° F. Thus, significant savings in energy costs may be realized using the solutions of the present invention, which solutions may be effectively applied at temperatures as much as 40 degrees less than those of the prior art solutions to produce water-break-free tin-plated surfaces that are not visibly etched.

The cleaner of the present invention may be formulated as an aqueous concentrate or as a solid cleaning composition to be added to water to produce the aqueous alkaline cleaning solutions of the present invention.

As an aqueous concentrate the cleaner is formulated such that when the aqueous concentrate is added to water at a concentration of about 0.5% to about 2% by volume it produces an aqueous alkaline cleaning solution having a pH of about 11 to about 13 for cleaning tin surfaces to substantially remove soil, lubricants or other contaminants therefrom without visibly etching the tin surface, even at low solution temperatures, and comprises an alkaline component in an amount effective to substantially remove said contaminants from the tin surface, and an inhibitor in an amount effective to inhibit etching of the surfaces. The inhibitor is a compound as defined above. The concentrate may preferably be added to water at a concentration of about 1% to about 2% by volume.

The alkaline component, as defined above, may preferably comprise up to about 770 grams per liter of the concentrate and more preferably may be present at from about 250 to about 500 grams per liter of the concentrate. The inhibitor may preferably comprise at least about 2 grams per liter of concentrate and more preferably may be present at from about 2 to about 6 grams per liter of the concentrate.

The concentrate may optionally contain a polyelectrolyte and/or one or more surfactants. The polyelectrolyte, as defined above, may preferably be added in an amount effective to substantially prohibit precipitation of the calcium and magnesium ions that are the primary cause of water hardness, and more preferably may be added at from about 10 to about 20 grams per liter of concentrate. As a solid cleaning composition the cleaner is formulated such that when the solid cleaning composition is added to water at a concentration of from about 3 g/l to about 7 g/l it produces an aqueous alkaline cleaning solution having a pH of about 11 to about 13 for cleaning tin surfaces to substantially remove soil, lubricants or other contaminants therefrom without visibly etching the tin surface, even at low solution temperatures, and comprises an alkaline component in an amount effective to substantially remove said contaminants from the tin surface, and an inhibitor in an amount effective to inhibit etching of the surface. The inhibitor is a compound as defined above. The cleaning composition may preferably be added to water at a concentration of about 4.6 g/l to about 6.7 g/l.

The alkaline component, as defined above, may preferably comprise at least about 15% by weight of the composition. The inhibitor may preferably comprise at least about 0.1% by weight of the composition. A particularly preferred concentration is from about 0.5% to about 2% by weight of the composition.

The composition, as defined above, may optionally contain a polyelectrolyte in an amount effective to substantially prevent precipitation of the calcium and magnesium ions that are the primary cause of water hardness. A preferred concentration for the polyelectrolyte is from 0% to about 10% by weight of the composition and more preferably from about 3% to about 10% by weight of the composition.

The cleaning composition may optionally contain, as diluents and the like, compounds that may be characterized as inert with respect to any possible positive or negative influence on the cleaning and non-etching properties of the cleaning solutions of the invention. Exemplary of such compounds is sodium sulphate.

The following examples present illustrative but non-limiting embodiments of the present invention.

EXAMPLES

In each of the following examples, sets of drawn and ironed tin-plated steel cans (hereinafter, DI cans) were contacted with the cleaning solution of the particular example. The cans were used within 24 hours of manufacture and were not treated in any way prior to being contacted with the cleaning solutions of the invention.

Cleaning compositions were prepared having the concentrations of components indicated in Table I. Each composition is identified by a number and a subscript "c". A specific amount, in grams, of each composition as indicated in Table II was then added to 6 liters of water to produce aqueous alkaline cleaning solutions having the concentrations of components indicated in Table III. Each cleaning solution is identified by the number of the composition used in its formulation along with the subscript "s". Surfactants were added in the concentrations indicated in Table III.

The chosen method of contacting the sets of cans with the cleaning solution in each example was spraying. The solutions were sprayed at about 25 psi for the times and at the temperatures defined in each example. The cans were then rinsed with water and visually observed for etching and appearance.

TABLE I

| | SOLID COMPOSITIONS (% by weight) | | | | | | | | | | | |
|---|---|---|---|---|---|---|---|---|---|---|---|---|
| COMPONENTS | 1c | 2c | 3c | 4c | 5c | 6c | 7c | 8c | 9c | 10c | 11c | 12c |
| Inhibitors | | | | | | | | | | | | |
| 3,4,5 - trihydroxybenzoic acid | 0.83 | 1.26 | 1.93 | X | 1.24 | 1 | 1 | 1 | 0.9 | X | X | X |
| 1,2,3 - benzenetriol | X | X | X | X | X | X | X | X | X | 9.83 | X | X |
| 1,4 - benzenenediol | X | X | X | X | X | X | X | X | X | X | X | 9.83 |
| 1,4 - benzoquinone | X | X | X | X | X | X | X | X | X | X | 9.83 | X |
| Alkaline Compounds | | | | | | | | | | | | |
| NaOH | 39.67 | 39.5 | 39.23 | 40 | 98.76 | 64 | 34 | 30 | 40 | 36.07 | 36.07 | 36.07 |
| $Na_2CO_3$ | 54.56 | 54.33 | 53.95 | 55 | X | 30 | 60 | 20 | 39.6 | 36.07 | 36.07 | 36.07 |
| $Na_2SiO_3$ | X | X | X | X | X | X | X | 44 | 15 | X | X | X |
| Polyelectrolytes | | | | | | | | | | | | |
| Gantrez (manufactured by GAF Corporation) | 4.94 | 4.91 | 4.89 | 5 | X | 5 | 5 | 5 | 4.5 | X | X | X |
| Sodium tripolyphosphate | X | X | X | X | X | X | X | X | X | 18.03 | 18.03 | 18.03 |

TABLE II

| | SOLID COMPOSITION | | | | | | | | | | | |
|---|---|---|---|---|---|---|---|---|---|---|---|---|
| | 1c | 2c | 3c | 4c | 5c | 6c | 7c | 8c | 9c | 10c | 11c | 12c |
| Grams of Composition Added To 6 liters of Water | 27.73 | 27.85 | 28.04 | 27.5 | 31.6 | 39.94 | 40.05 | 40.09 | 27.45 | 30.5 | 30.5 | 30.5 |
| Water Used* | | | | | | | | | | | | |
| Deionized | + | + | + | + | | | | | | + | + | + |
| Tap Water** | | | | | + | + | + | + | + | | | |

*A "+" indicates the water used

**The tap water used was relatively hard having a hardness of about 300 ppm

TABLE III

| COMPONENTS | AQUEOUS ALKALINE CLEANING SOLUTION (g/l) | | | | | | | | | | | |
|---|---|---|---|---|---|---|---|---|---|---|---|---|
| | $1_s$ | $2_s$ | $3_s$ | $4_s$ | $5_s$ | $6_s$ | $7_s$ | $8_s$ | $9_s$ | $10_s$ | $11_s$ | $12_s$ |
| Inhibitors | | | | | | | | | | | | |
| 3,4,5 - trihydroxybenzoic acid | 0.038 | 0.058 | 0.09 | X | 0.054 | 0.067 | 0.067 | 0.067 | 0.041 | X | X | X |
| 1,2,3 - benzenetriol | X | X | X | X | X | X | X | X | X | 0.49 | X | X |
| 1,4 - benzenediol | X | X | X | X | X | X | X | X | X | X | X | 0.49 |
| 1,4 - benzoquinone | X | X | X | X | X | X | X | X | X | X | 0.49 | X |
| Alkaline Compounds | | | | | | | | | | | | |
| NaOH | 1.83 | 1.83 | 1.83 | 1.83 | 5.2 | 4.26 | 2.27 | 2 | 1.83 | 1.83 | 1.83 | 1.83 |
| $Na_2CO_3$ | 2.52 | 2.52 | 2.52 | 2.52 | X | 2 | 4 | 1.33 | 1.82 | 1.83 | 1.83 | 1.83 |
| $Na_2SiO_3$ | X | X | X | X | X | X | X | 2.94 | 0.69 | X | X | X |
| Polyelectrolytes | | | | | | | | | | | | |
| Gantrez (manufactured by GAF Corporation) | 0.23 | 0.23 | 0.23 | 0.23 | X | 0.33 | 0.33 | 0.33 | 0.21 | X | X | X |
| Sodium tripolyphosphate | X | X | X | X | X | X | X | X | X | 0.92 | 0.92 | 0.92 |
| Surfactants | | | | | | | | | | | | |
| Poly-Tergent S-505-LF (manufactured by Olin Corporation) | X | X | X | X | X | 0.67 | 0.67 | X | X | X | X | X |
| Plurafac D-25 (manufactured by BASF Wyandotte Corporation) | 0.33 | 0.33 | 0.33 | 0.33 | 0.35 | X | X | 0.35 | 0.33 | X | X | X |
| Plurafac A-38 (manufactured by BASF Wyandotte Corporation) | X | X | X | X | X | X | X | 0.083 | X | X | X | X |
| Tergitol Min-Foam 1X (manufactured by Union Carbide Corporation) | X | X | X | X | X | X | X | X | X | 0.42 | 0.42 | 0.42 |
| Defoamers | | | | | | | | | | | | |
| Pluronic 31R1 (manufactured by BASF Wyandotte Corporation) | 0.83 | 0.83 | 0.83 | 0.83 | 0.087 | X | X | 0.23 | 0.083 | X | X | X |
| Solution pH (measured at a solution temperature of about 27° C.) | 12.7 | 12.7 | 12.7 | 12.7 | 12.8 | 12.6 | 12.3 | 12.3 | 12.6 | 12.4 | 12.4 | 12.4 |

EXAMPLE 1

Sets of DI cans, were sprayed, one set per solution, with cleaning solutions $1_s$, $2_s$, $3_s$ and $4_s$, for 10 minutes at 123° F. The results are summarized in Table IV.

TABLE IV

| Cleaning Solution | Observation of Result |
|---|---|
| $1_s$ | No detinning; water-break-free cans; bright, rust-free surface |
| $2_s$ | No detinning; water-break-free cans; bright, rust-free surface |
| $3_s$ | No detinning; water-break-free cans; bright, rust-free surface |
| $4_s$ | Severe detinning |

EXAMPLE 2

Sets of DI cans were sprayed, one set per test, with cleaning solution $5_s$ for the times and at the temperatures indicated and the results are summarized in Table V.

TABLE V

| Solution Temperature | Treatment Time | Observed Result |
|---|---|---|
| 125° F. | 1 minute | No detinning; bright, rust-free surface; water-break-free cans |
| 125° F. | 30 minutes | No detinning; bright, rust-free surface; water-break-free cans |

TABLE V-continued

| Solution Temperature | Treatment Time | Observed Result |
|---|---|---|
| 127° F. | 1 minute | No detinning; bright, rust-free surface; water-break-free cans |
| 127° F. | 30 minutes | No detinning; bright, rust-free surface; water-break-free cans |

EXAMPLE 3

Sets of DI cans were sprayed with cleaning solutions $6_s$, $7_s$, $8_s$ and $9_s$, one set per test, for the times and at the temperatures indicated. The results are summarized in Table VI.

TABLE VI

| Cleaning Solution | Solution Temperature | Treatment Time | Observed Result |
|---|---|---|---|
| $6_s$ | 120° | 1 minute | No detinning; bright, rust-free surface; water-break-free cans |
| $7_s$ | 120° | 1 minute | No detinning; bright, rust-free surface; water-break-free cans |
| $8_s$ | 120° | 1 minute | No detinning; bright, rust-free surface; water-break-free cans |
| $9_s$ | 120° | 1 minute | No detinning; |

TABLE VI-continued

| Cleaning Solution | Solution Temperature | Treatment Time | Observed Result |
|---|---|---|---|
| | | | bright, rust-free surface; water-break-free cans |
| $9_s$ | 120° | 15 minutes | No detinning; bright, rust-free surface; water-break-free cans |
| $9_s$ | 120° | 30 minutes | No detinning; bright, rust-free surface; water-break-free cans |
| $9_s$ | 124° | 1 minute | No detinning; bright, rust-free surface; water-break-free cans |
| $9_s$ | 124° | 15 minutes | No detinning; bright, rust-free surface; water-break-free cans |
| $9_s$ | 124° | 30 minutes | No detinning; bright, rust-free surface; water-break-free cans |

EXAMPLE 4

Sets of DI cans were sprayed with cleaning solutions $10_s$, $11_s$ and $12_s$, one set per test, for the times and at the temperatures indicated. The results are summarized in Table VIII.

TABLE VII

| Cleaning Solution | Solution Temperature | Treatment Time | Observed Result |
|---|---|---|---|
| $10_s$ | 125° F. | 1 minute | No detinning; bright, rust-free surface; water-break-free cans |
| $11_s$ | 125° F. | 1 minute | No detinning; bright, rust-free surface; water-break-free cans |
| $12_s$ | 125° F. | 1 minute | No detinning; bright, rust-free surface; water-break-free cans |
| $10_s$ | 125° F. | 30 minutes | No detinning; bright, rust-free surface; water-break-free cans |
| $11_s$ | 125° F. | 30 minutes | No detinning; bright, rust-free surface; water-break-free cans |
| $12_s$ | 125° F. | 30 minutes | No detinning; bright, rust-free surface; water-break-free cans |
| $10_s$ | 150° F. | 1 minute | No detinning; bright, rust-free surface; water-break-free cans |
| $11_s$ | 150° F. | 1 minute | No detinning; bright, rust-free surface; water-break-free cans |
| $12_s$ | 150° F. | 1 minute | No detinning; bright, rust-free surface; water-break-free cans |

TABLE VII-continued

| Cleaning Solution | Solution Temperature | Treatment Time | Observed Result |
|---|---|---|---|
| $10_s$ | 150° F. | 30 minutes | No detinning; bright, rust-free surface; water-break-free cans |
| $11_s$ | 150° F. | 30 minutes | No detinning; bright, rust-free surface; water-break-free cans |
| $12_s$ | 150° F. | 30 minutes | No detinning; bright, rust-free surface; water-break-free cans |

EXAMPLE 5

Aqueous concentrates were prepared having the concentrations of components indicated in Table VIII. These concentrates are designated 13 aq and 14 aq.

Aqueous alkaline cleaning solutions $13_s$ and $14_s$ were formulated, respectively, by diluting 11.4 milliliters of aqueous concentrate 13 aq to 1 liter with tap water and by diluting 10 milliliters of aqueous concentrate 14 aq to 1 liter with deionized water. Surfactants were added in the concentrations indicated. The cleaning solutions had the concentrations of components indicated in Table VIII.

TABLE VIII

| COMPONENTS | Aqueous CONCENTRATE (g/1) 13 aq | 14 aq | CLEANING SOLUTION (g/1) $13_s$ | $14_s$ |
|---|---|---|---|---|
| Alkaline Compounds | | | | |
| KOH | 300 | 112.6 | 3.42 | 1.13 |
| Kasil #6 (a potassium silicate manufactured by PQ Corporation) | X | 159.16 | X | 1.59 |
| $Na_2CO_3$ | 160.9 | 202.7 | 1.83 | 2.03 |
| "N" sodium silicate (manufactured by PQ Corporation) | 125.5 | X | 1.43 | X |
| Inhibitors | | | | |
| 3,4,5-trihydroxybenzoic acid | 4.02 | 4.5 | 0.046 | 0.05 |
| Polyelectrolytes | | | | |
| Gantrez (manufactured by GAF Corporation) | 18.5 | 22.5 | 0.21 | 0.23 |
| Surfactants | | | | |
| Plurafac D-25 (manufactured by BASF Wyandotte Corporation) | X | X | 0.33 | X |
| Defoamers | | | | |
| Pluronic 31R1 (manufactured by BASF Wyandotte Corporation) | X | X | 0.083 | X |
| pH (measured at about 27° C.) | X | X | 12.4 | 12.4 |

Sets of DI cans were sprayed with cleaning solutions $13_s$ and $14_s$, one set per test, for the times and at the temperatures indicated. The results are summarized in Table IX.

TABLE IX

| Cleaning Solution | Solution Temperature | Treatment Time | Observed Result |
|---|---|---|---|
| $13_s$ | 120° F. | 1 minute | No detinning; bright; rust-free surface; water-break-free cans |
| $14_s$ | 120° F. | 1 minute | No detinning; bright, rust- |

TABLE IX-continued

| Cleaning Solution | Solution Temperature | Treatment Time | Observed Result |
|---|---|---|---|
| | | | free surface; water-break-free cans |
| $13_s$ | 124° F. | 30 minutes | No detinning; bright, rust-free surface; water-break-free cans |
| $13_s$ | 128° F. | 30 minutes | No detinning; bright, rust-free surface; water-break-free cans |

EXAMPLE 6

Cleaning solutions $15_s$, $16_s$ and $17_s$ were prepared using tap water and having the concentrations of components indicated in Table X. Solution $17_s$ does not contain an inhibitor and thus, like cleaning solution $4_s$ in Example 1, is presented for purposes of comparison.

TABLE X

| COMPONENT | CLEANING SOLUTION $15_s$ | $16_s$ | $17_s$ |
|---|---|---|---|
| Inhibitor | | | |
| 1,4-dihydroxybenzene | 0.05 | 0.05 | X |
| Alkaline Compound | | | |
| $Na_2SiO_3$ | 4.33 | 4.33 | 4.33 |
| Polyelectrolyte | | | |
| TamoT 960 (manufactured by Rohm and Haas Co.) | 0.67 | 0.47 | 0.67 |
| Surfactant | | | |
| Poly-Tergent S-505-LF (manufactured by Olin Corp) | 0.42 | 0.42 | 0.42 |
| pH | 12.4 | 12.4 | 12.4 |

Sets of DI cans were sprayed with cleaning solutions $15_s$, $16_s$ and $17_s$, one set per test, at solution temperatures of 124° F. for the times indicated. The results are summarized in Table XI.

TABLE XI

| Cleaning Solution | Treatment Time | Observed Result |
|---|---|---|
| $15_s$ | 1 minute | No detinning; bright, rust-free surface; water-break-free cans |
| $16_s$ | 1 minute | No detinning; bright, rust-free surface, water-break-free cans |
| $17_s$ | 1 minute | Spotty whitening; some detinning |
| $15_s$ | 30 minutes | No detinning; bright, rust-free surface, water-break-free cans |
| $16_s$ | 30 minutes | No detinning; bright, rust-free surface; water-break-free cans |
| $17_s$ | 30 minutes | Badly mottled dark surface; severe detinning |

I claim:

1. A process for cleaning tin surfaces to substantially remove soil, lubricants or other contaminants therefrom without visibly etching the tin surface, comprising contacting said surface at a temperature effective to substantially remove said contaminants from the tin surface with an aqueous cleaning solution having a pH about 11 to about 13 comprising an alkaline component in an amount effective to substantially remove said contaminant from the tin surface, and an inhibitor in an amount effective to inhibit etching of the surface, said inhibitor being selected from the group consisting of benzoquinones, and substituted benzoquinones, wherein the substituents on the said substituted benzoquinones are selected from the group consisting of hydroxy, hydrogen, halo, alkyl, alkyldienyl, alkoxy, nitro and cyano.

2. A process according to claim 1, wherein the cleaning temperature is about 100° F. to about 130° F.

3. A process according to claim 1 or 2 wherein the concentration of alkaline component in the cleaning solution is about 3 g/l to about 5 g/l.

4. A process according to claim 3 wherein the concentration of the inhibitor in the cleaning solution is about 0.02 g/l to about 0.06 g/l.

5. The process according to claim 4 wherein the inhibitor is selected from the group consisting of 1,4-benzoquinone, 1,2-benzoquinone, α-naphthaquinone, and β-naphthaquinone.

6. The process according to claim 4 wherein the inhibitor is selected from the group consisting of benzoquinones and substituted benzoquinones of the formulae

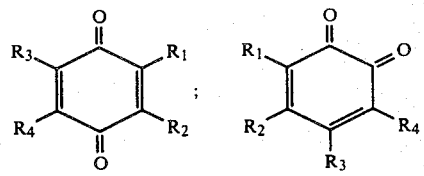

wherein:

$R_1$, $R_2$, $R_3$ and $R_4$ are hydrogen, hydroxy, alkyl, halo, carboxyl, alkoxy, nitro or cyano; or $R_1$ and $R_2$ are together an alkyldienyl group, and together with the quinone ring to which they are attached, form a naphthaquinone.

7. The process according to claim 3 wherein the alkaline component of the cleaning solution is selected from the group consisting of alkali metal hydroxides, carbonates, and silicates, ammonium hydroxides and carbonates, and mixtures thereof.

8. The process of claim 7 wherein the alkaline component comprises a mixture of sodium metasilicate, sodium carbonate and a compound selected from the group consisting of sodium hydroxide and potassium hydroxide.

9. The process of claim 1 wherein the cleaning solution includes a polyelectrolyte in an amount effective to substantially prevent precipitation.

10. The process of claim 9 wherein the amount of polyelectrolyte is at least about 0.1 g/l.

11. The process of claim 1 wherein the cleaning solution includes at least about 0.2 g/l of one or more surfactants.

12. The process of claim 11 wherein the surfactant comprises about 0.2 g/l to about 0.5 g/l.

13. The process of claim 11 or 12 wherein the cleaning solution includes a low foaming nonionic surfactant.

14. The process of claim 1 wherein the surface is contacted with the cleaning solution by spraying.

15. The process of claim 1 including rinsing the surface with water after it is contacted with the cleaning solution.

16. An aqueous cleaning composition having a pH of about 11 to about 13 for cleaning tin surfaces to substantially remove soil, lubricants or other contaminants therefrom without visibly etching the tin surface, at temperatures between about 100° F. to about 130° F., comprising an alkaline component in an amount effective to substantially remove said contaminants from the tin surface and an inhibitor in an amount effective to inhibit visible etching of the surface, said inhibitor being selected from the group consisting of benzoquinones and substituted benzoquinones.

17. A cleaning solution according to claim 16 wherein the benzoquinones and substituted benzoquinones are of the formulae

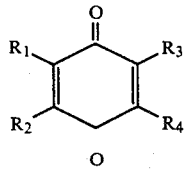

wherein:

$R_1$, $R_2$, $R_3$ and $R_4$ are hydrogen, hydroxy, halo, alkoxy, alkyl, carboxyl, nitro, and cyano; or $R_1$ and $R_2$ form an alkyldienyl group, and together with the quinone ring to which they are attached, form a napthaquinone.

18. A cleaning composition according to claim 16 or 18 wherein the inhibitor is selected from the group consisting of 1,2-benzoquinone, 1,4-benzoquinone, and substituted benzoquinones.

19. A cleaning composition according to claim 16 wherein the amount of inhibitor is about 0.02 g/l to about 0.06 g/l.

20. A cleaning composition according to claim 16 wherein the alkaline component of the cleaning solution is selected from the group consisting of alkali metal hydroxides, carbonates, and silicates, ammonium hydroxides and carbonates and mixtures thereof.

21. A cleaning composition according to claim 20 wherein the alkaline component comprises a mixture of sodium metasilicate, sodium carbonate and a compound selected from the group consisting of sodium hydroxide and potassium hydroxide.

22. A cleaning composition according to claim 16 including a polyelectrolyte in an amount effective to substantially prevent precipitation.

23. A cleaning composition according to claim 22 wherein the amount of polyelectrolyte is at least about 0.1 g/l.

24. A solid cleaning composition which when added to water at a concentration of from about 3 g/l to about 7 g/l produces an aqueous alkaline cleaning solution having a pH of about 11 to about 13 for cleaning tin surfaces to substantially remove soil, lubricants or other contaminants therefrom without visibly etching the tin surface, and which comprises an alkaline component and an inhibitor in an amount effective to inhibit etching of the surface, said inhibitor being selected from the group consisting of benzoquinones and substituted benzoquinones.

25. A solid cleaning composition according to claim 24 wherein the benzoquinones and substituted benzoquinones are of the formulae

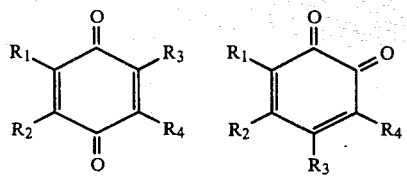

wherein:

$R_1$, $R_2$, $R_3$ and $R_4$ are hydrogen, hydroxy, halo, alkoxy, alkyl, carboxyl, nitro, and cyano; or $R_1$ and $R_2$ form an alkyldienyl group, and together with the quinone ring to which they are attached, form a napthaquinone.

26. The solid cleaning composition of claim 24 wherein the alkaline component comprises at least about 15% by weight of the composition.

27. The solid cleaning composition of claim 24 wherein the alkaline component is selected from the group consisting of alkali metal hydroxides, carbonates and silicates, ammonium hydroxides and carbonates, and mixtures thereof.

28. The solid cleaning composition of claim 24 wherein the inhibitor comprises at least about 0.1% by weight of the composition.

29. The solid cleaning composition of claim 24 including a polyelectrolyte in an amount effective to substantially prevent precipitation.

30. An aqueous concentrate which when added to water at a concentration of about 0.5% to about 2% by volume produces an aqueous alkaline cleaning solution having a pH of about 11 to about 13 for cleaning tin surfaces to substantially remove soil, lubricants or other contaminants therefrom without visibly etching the tin surface and which comprises an alkaline component in an amount effective to substantially remove said contaminants from the tin surface, and an inhibitor, in an amount effective to inhibit etching of the surface, said inhibitor being selected from the group consisting of benzoquinones and substituted benzoquinones.

31. The concentrate of claim 30 wherein the alkaline component comprises up to about 770 grams per liter of concentrate.

32. The concentrate of claim 30 wherein the inhibitor comprises at least about 2 grams per liter of concentrate.

33. The concentrate of claim 30 including a polyelectrolyte in an amount effective to substantially prevent precipitation.

34. The concentrate of claim 30 or 32 wherein benzoquinones and substituted benzoquinones are of the formulae

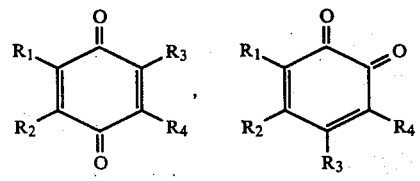

wherein:

$R_1$, $R_2$, $R_3$ and $R_4$ are hydrogen, hydroxy, halo, alkoxy, alkyl, carboxyl, nitro, and cyano; or $R_1$ and $R_2$ form an alkyldienyl group, and together with the quinone ring to which they are attached, form a naphthaquinone.

35. An aqueous cleaning composition having a pH of about 11 to about 13 for cleaning tin surfaces to substantially remove soil, lubricants or other contaminants therefrom without visibly etching the tin surface, at temperatures between about 100° F. to 130° F., comprising an alkaline component in an amount effective to substantially remove said contaminants from the tin surface, and an inhibitor in an amount effective to inhibit visible etching of the surface, said inhibitor being selected from the group consisting of 1,2,4-trihydroxybenzene, 1,3,5-trihydroxybenzene, and 1,2,4,5-tetrahydroxybenzene.

36. A cleaning composition according to claim 35 wherein the amount of inhibitor is about 0.03 g/l to about 0.06 g/l.

37. A solid cleaning composition which when added to water at a concentration of from about 3 g/l to about 7 g/l produces an aqueous alkaline cleaning solution having a pH of about 11 to about 13 for cleaning tin surfaces to substantially remove soil, lubricants or other contaminants therefrom without visibly etching the tin surface, and which comprises an alkaline component and about 0.5% to about 2% by weight of an inhibitor selected from the group consisting of 1,2,4-trihydroxybenzene, 1,3,5-trihydroxybenzene, and 1,2,4,5-tetrahydroxybenzene.

38. An aqueous concentrate which when added to water at a concentration of about 0.5% to about 2% by volume produces an aqueous alkaline cleaning solution having a pH of about 11 to about 13 for cleaning tin surfaces to substantially remove soil, lubricants or other contaminants therefrom without visibly etching the tin surface and which comprises an alkaline component in an amount effective to substantially remove said contaminants from the tin surface, and an inhibitor in an amount effective to inhibit visible etching of the surface, said inhibitor being selected from the group consisting of 1,2,4-trihydroxybenzene, 1,3,5-trihydroxybenzene, and 1,2,4,5-tetrahydroxybenzene.

* * * * *